US006499385B2

(12) United States Patent
Protti

(10) Patent No.: US 6,499,385 B2
(45) Date of Patent: Dec. 31, 2002

(54) HAND VACUUM PUMP WITH LINEAR PISTON ACTUATION

(75) Inventor: John Protti, Long Beach, CA (US)

(73) Assignee: Innova Electronics Corporation, Fountain Valley, CA (US)

( * ) Notice: Subject to any disclaimer, the term of this patent is extended or adjusted under 35 U.S.C. 154(b) by 21 days.

(21) Appl. No.: 09/797,387

(22) Filed: Mar. 1, 2001

(65) Prior Publication Data

US 2002/0124718 A1 Sep. 12, 2002

(51) Int. Cl.[7] ..... F01B 9/00

(52) U.S. Cl. ..... 92/140; 92/161; 74/102; 74/518

(58) Field of Search ..... 92/140, 161; 74/102, 74/518; 417/440

(56) References Cited

U.S. PATENT DOCUMENTS

| | | | | |
|---|---|---|---|---|
| 1,946,166 A | | 2/1934 | Kovach | 230/46 |
| 1,963,576 A | | 6/1934 | Boerlage | 230/40 |
| 2,138,605 A | | 11/1938 | Landis | 128/214 |
| 2,148,929 A | | 2/1939 | Dalton | 103/10 |
| 2,274,304 A | | 2/1942 | Perry | 309/4 |
| 2,297,655 A | | 9/1942 | Koch | 309/4 |
| 2,491,633 A | | 12/1949 | Yuza | 222/133 |
| 2,895,424 A | | 6/1959 | Tramontini et al. | 103/150 |
| 2,941,854 A | | 6/1960 | Jemander | 309/23 |
| 2,973,231 A | | 2/1961 | Reynolds | 309/33 |
| 3,612,722 A | | 10/1971 | Neward | 417/63 |
| 3,664,774 A | | 5/1972 | Tupper et al. | 417/560 |
| 3,824,043 A | | 7/1974 | Nordell | 417/440 |
| 3,900,276 A | | 8/1975 | Dilworth | 417/542 |
| 3,957,399 A | | 5/1976 | Siczek | 417/387 |
| 3,961,869 A | | 6/1976 | Droege, Sr. et al. | 417/555 |
| 3,981,636 A | | 9/1976 | Aoki et al. | 417/566 |
| 4,205,641 A | | 6/1980 | Yamasaki et al. | 123/179 |
| 4,231,724 A | | 11/1980 | Hope et al. | 417/472 |
| 4,259,042 A | | 3/1981 | Heatherly | 417/566 |
| 4,278,114 A | | 7/1981 | Ruberg | 141/65 |
| 4,285,641 A | | 8/1981 | Brimhall | 417/442 |
| 4,565,506 A | | 1/1986 | Williams | 417/440 |
| 4,775,302 A | | 10/1988 | Neward | 417/440 |
| 4,954,054 A | | 9/1990 | Neward | 417/440 |
| 5,277,557 A | * | 1/1994 | Cooper | 417/440 |
| 5,362,214 A | * | 11/1994 | Neward | 417/440 |

FOREIGN PATENT DOCUMENTS

| | | |
|---|---|---|
| FR | 1375871 | 9/1964 |
| GB | 389075 | 6/1931 |
| IT | 312638 | 11/1933 |

* cited by examiner

*Primary Examiner*—Edward K. Look
*Assistant Examiner*—Thomas E. Lazo
(74) *Attorney, Agent, or Firm*—Stetina Brunda Garred & Brucker

(57) ABSTRACT

A hand-held vacuum pump has a piston for drawing a vacuum. The pump has a piston rod having a piston end and a distal end. The piston end is attached to the piston. The pump further has a pivot lever having a rod end, a handle end, and a pivot interface disposed therebetween. The rod end is rotatably attached to the distal end. The pump has a pivot support having a support interface. The support interface is cooperatively sized and configured with the pivot interface to translate the rod end of the pivot lever in substantially axial movement of the piston rod.

18 Claims, 3 Drawing Sheets

HAND VACUUM PUMP WITH LINEAR PISTON ACTUATION

CROSS-REFERENCE TO RELATED APPLICATIONS (Not Applicable)

STATEMENT RE: FEDERALLY SPONSORED RESEARCH/DEVELOPMENT (Not Applicable)

BACKGROUND OF THE INVENTION

The present invention relates generally to hand-held vacuum pumps, and more particularly to a vacuum pump having a rod end of a pivot lever thereof for substantially axial movement of a piston rod.

Some examples of prior art hand-held vacuum pumps are disclosed in U.S. Pat. Nos. 4,954,054 and 4,775,302. Such hand-held vacuum pumps generally include a housing structure having a cylinder formed therein. A piston is movable in slidable engagement with the cylinder for forming a vacuum chamber within the housing structure. A port is provided to the vacuum chamber. The movement of the piston is actuated though the use of a piston rod which extends axially from the piston as well as the cylinder about the piston. Extending from the housing is typically a forward handle. The vacuum pump additionally includes a pivot lever. The pivot lever includes a rod end, an opposing handle end and a central attachment point. The rod end is rotatably connected to the piston rod and the cental attachment point is rotatably connected to the housing. In this regard, a linkage is formed such that clasped engagement of the forward handle and the handle end of the pivot lever causes a rotation or pivoting of the pivot lever about the central attachment point. This results in the piston end of the pivot lever moving in an arced path. While such an arced path includes a substantial axial component along the piston rod for drawing the piston rod and attached piston, there is an inherent transverse component which is undesirable.

It is contemplated that transverse or lateral movement of the piston rod results in misalignment of the piston within the cylinder. This can result in piston-to-cylinder seal problems thereby adversely affecting the efficient creation and/or maintenance of a vacuum within the cylinder. Accordingly, there is a need in the art for an improved vacuum pump in comparison to the prior art.

BRIEF SUMMARY OF THE INVENTION

In accordance with an embodiment of the present invention, there is provided a hand-held vacuum pump. The vacuum pump is provided with a piston for drawing a vacuum. The vacuum pump is further provided with a piston rod having a piston end and a distal end. The piston end is attached to the piston. The vacuum pump is further provided with a pivot lever having a rod end, a handle end, and a pivot interface pivot interface disposed therebetween. The rod end is rotatably attached to the distal end of the piston rod. The vacuum pump is further provided with a pivot support having a support interface. The support interface and the pivot interface are cooperatively sized and configured to translate the rod end of the pivot lever for substantially axial movement of the piston rod upon rotation of the pivot lever about the support interface in response to actuation of the handle end of the pivot lever.

According to an aspect of the present invention, the pivot interface has at least two stepped pivot members. Further, the support interface has at least two stepped support members which are sized and configured to sequentially cradle respective ones of the at least two stepped pivot members for rotating the pivot lever about the support interface.

In an embodiment of the present invention, the support interface and the pivot interface are cooperatively sized and configured to translate the rod end of the pivot lever along sequential arced paths associated with respective cradling of the stepped pivot members with the stepped support members. It is contemplated that substantially axial movement of the piston rod results upon rotation of the pivot lever about the support interface in response to actuation of the handle end of the pivot lever. In this regard, such arced paths are contemplated to merge into each other resulting in a substantially linear path in comparison to prior art single pivot point lever movement along a single arced path. Preferably, the at least two stepped support members comprises three stepped support members, and the at least two stepped support members comprises three stepped support members. Further, the stepped pivot members may be convex V-shaped and the stepped support members may be concave V-shaped. In addition, the vacuum pump may include a forward handle disposed in fixed relation to the pivot support for actuating the piston upon clasped engagement of the forward handle and the handle end of the pivot lever towards each other. The pivot support may be integrated with the forward handle. Further, the pivot lever may include a rotational stop sized and configured to engage the pivot support for preventing rotation of the pivot lever.

As such, based on the foregoing, the present invention mitigates the inefficiencies and limitations associated with prior art vacuum pump designs. Advantageously, the support interface and the pivot interface are specifically sized and configured to translate the rod end of the pivot lever for substantially axial movement of the piston rod. This is because the location about which the pivot lever pivots or rotates is not fixed in relation to the pivot support, but rather multiple pivot locations may be realized. This in effect results in multiple arced paths or segments in which the piston end of the pivot lever travels. Such arced paths are contemplated to merge into each other. In comparison to prior art designs having a single point of rotation, the design of the present invention results in less transverse or lateral movement of the piston end of the pivot lever. This effectively breaks a single arced path into several shorter merging arced paths, which forms a substantially straight path by comparison.

Another advantage of the present invention is that the associated pivot lever may be reduced in sizing, thereby reducing the overall sizing the vacuum pump in general. This is because, the prior art single pivot point designs, the amount of transverse or lateral movement of the piston end of the pivot lever is a function of the distance from the pivot end to the pivot point. The shorter the distance (i.e., radius), the tighter the associated arc. As such, in order to achieve a certain maximum transverse movement specification, the pivot lever and associated single pivot point is required to be at least a certain size. The present invention has the effect of uncoupling the nature of any transverse motion away from the overall sizing of the pivot lever and towards the configuration of the pivot and support interfaces. This allows for comparative reduction in pivot lever sizing and therefore a reduction in the overall sizing of the vacuum pump itself.

In addition, the use of the pivot interface and the support interface results in the aforementioned advantages without the utilization of additional moving parts in comparison to prior art single rotation point vacuum pump designs. In this respect, it is contemplated that various linkage arrangements could be implemented which include additional moving parts between a traditional single rotation point pivot lever and a piston, so as to facilitate mitigation of lateral or transverse forces being applied to the piston rod and piston arrangement. This would include a rotational attachment of the piston rod to the piston. As such, undesirable costs are associated with such parts or connections, including assembly thereof. Moreover, additional linkage elements tend to introduce tolerance and/or precision errors into the system associated with the controlled actuation of the movement of the piston rod. As the present invention avoids such problems as no additional moving linkage parts are required.

Accordingly, the present invention represents a significant advance in the art.

BRIEF DESCRIPTION OF THE DRAWINGS

These, as well as other features of the present invention, will become more apparent upon reference to the drawings wherein.

DETAILED DESCRIPTION OF THE INVENTION

Figure 2:
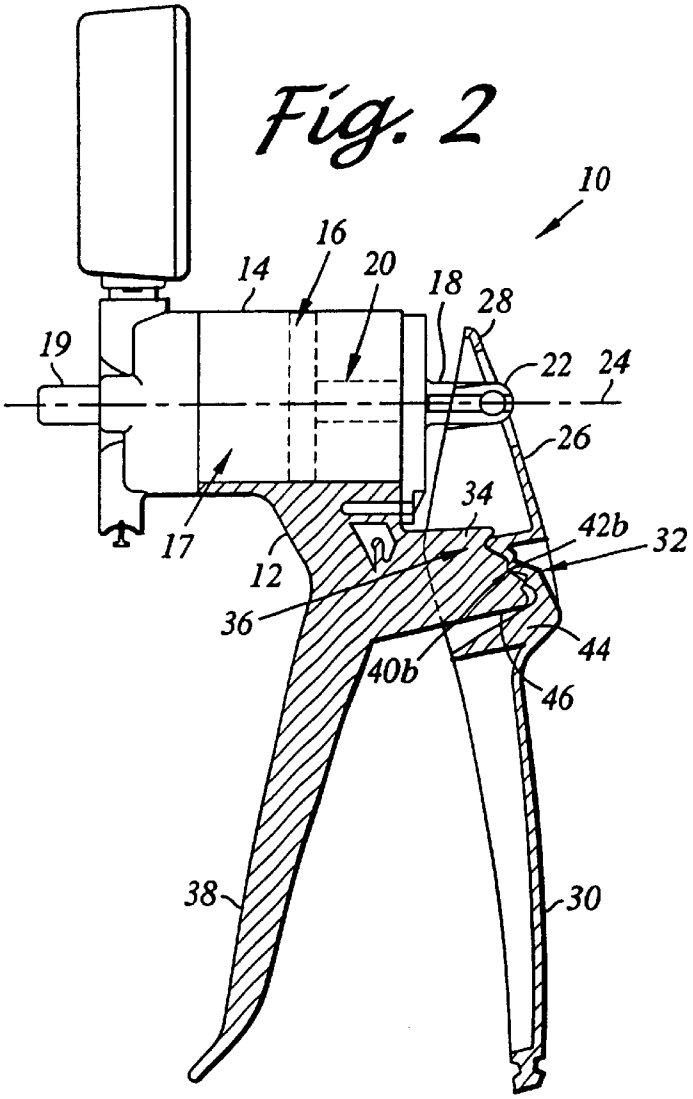
FIG. 2 is the vacuum pump of FIG. 1 with a piston end of the pivot lever rotated rearward.

Referring now to the drawings wherein the showings are for purposes of illustrating a preferred embodiment of the present invention only, and not for purposes of limiting the same, FIGS. 1–6 illustrate the hand-held vacuum pump of the present invention.

Referring now to FIGS. 1–4 there is depicted a cross-sectional view of a hand-held vacuum pump 10 in accordance with the present invention. As will be discussed in further detail below, FIGS. 1–4 sequentially an depict a pivot lever 26 in various rotational orientations.

As depicted, the vacuum pump 10 includes a housing 12 having a cylinder 14. The cylinder 14 is sized and configured to concentrically receive a piston 16 (shown in phantom). The piston 16 is disposed in sealed slidable engagement with the cylinder 14. The cylinder 14 and the piston 16 cooperatively form a vacuum chamber 17. Axial movement of the piston 16 so as to enlarge the volume of the vacuum chamber 17 is contemplated to create desired vacuum pressures. Such vacuum pressures may be vented via a vacuum port 19 extending from the vacuum chamber 17.

The cylinder 14 defines a longitudinal axis 24. In order to efficiently maintain sealed slidable engagement between the piston 16 and the cylinder 14 it is desirable that the piston 16 is configured to translate along the longitudinal axis 24. In this regard, it is desirable that any forces acting upon the piston be limited to those forces which only include components parallel, a more preferably along, the longitudinal axis 24.

As such, the vacuum pump 10 is provided with a piston rod 18 (partially shown in phantom). The piston rod 18 has a piston end 20 (shown in phantom) and a distal end 22. The piston rod 18 may be configured to extend along the longitudinal axis 24. The piston end 20 is connected to the piston 16.

Figure 6:
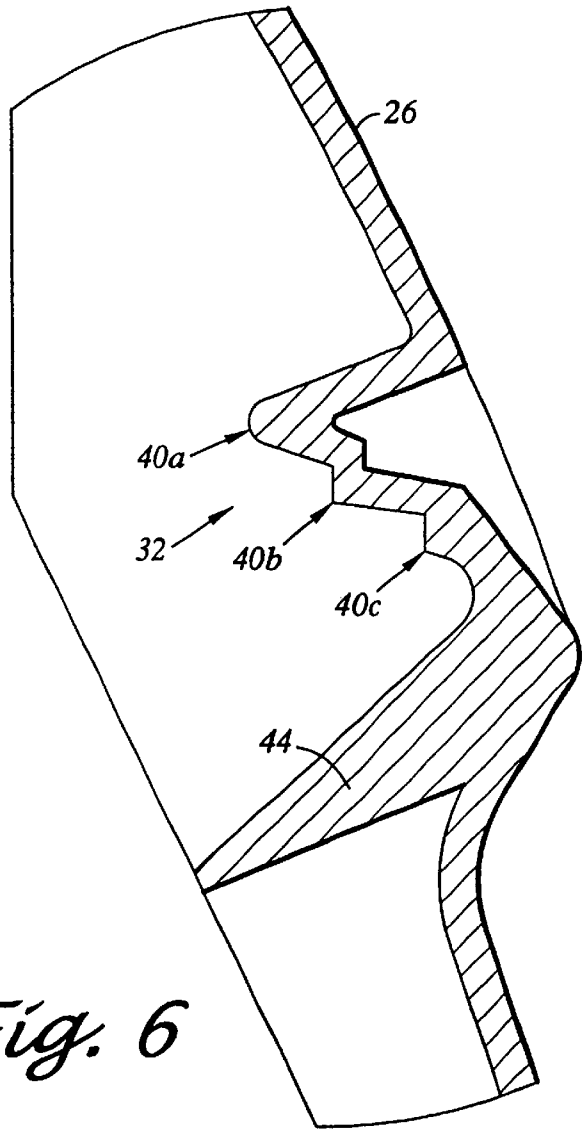
FIG. 6 is an enlarged view of a stepped pivot interface of the vacuum pump shown in FIG. 1.
Figure 5:
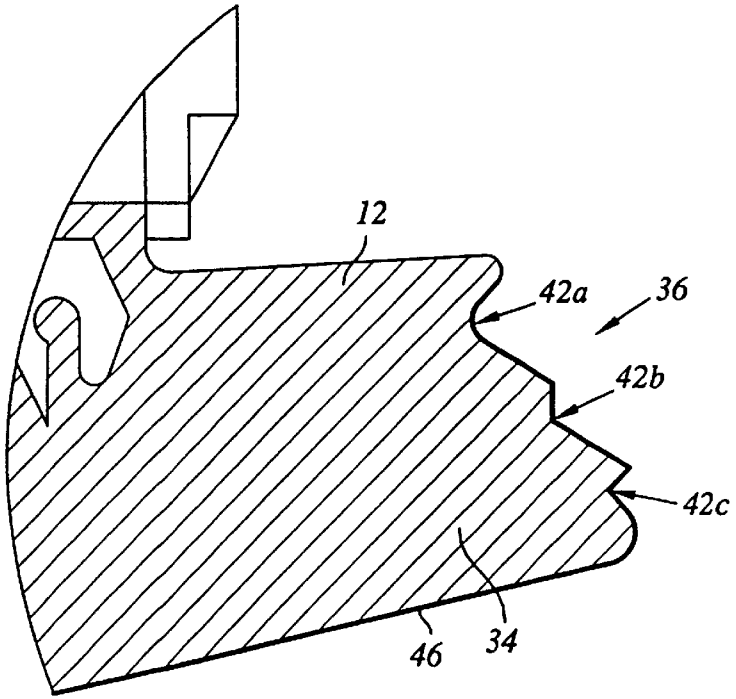
FIG. 5 is an enlarged view of a support interface of the vacuum pump shown in FIG. 1.

The vacuum pump 10 is further provided with a pivot lever 26 having a rod end 28, a handle end 30, and a pivot interface 32 disposed therebetween. Although not required, the pivot lever 26 may conveniently be of a single piece construction which may comprise a plastic, for example. The rod end 28 is rotatably attached to the distal end 22 of the piston rod 18. FIG. 6 depicts an enlarged view of the pivot interface 32 of FIG. 1. The vacuum pump 10 is further provided with a pivot support 34. The pivot support 12 may be attached and extend from the housing 12 as shown. FIG. 5 depicts an enlarged view of the support interface 36 of FIGS. 1. Further, the support interface 36 and the pivot interface 32 are cooperatively sized and configured to translate the rod end 28 of the pivot lever 26 for substantially axial movement of the piston rod 18 upon rotation of the pivot lever 26 about the support interface 36 in response to actuation of the handle end 30 of the pivot lever 26. As used herein, substantially axial movement refers to movement which includes a less of a transverse or lateral component in relation to the longitudinal axis 24 in comparison to a single point of rotation arrangement of the pivot lever 26. Suitable placements and configurations of the support interface 36 and the pivot interface 32 may be chosen from those method and techniques, such as through the application of traditional kinematic principals, which are well known to one of ordinary skill, including those familiar with cam technology.

According to an embodiment of the present invention, the pivot interface 32 includes at least two stepped pivot members 40. As shown three stepped pivot members 40 (denoted 40*a*, 40*b* and 40*c*). Preferably, the stepped pivot members 40 are convex V-shaped. Further, the tip of such V-shape is preferably rounded. The support interface 36 includes at least two stepped support members 42. As shown, three stepped support members 42 (denoted 42*a*, 42*b* and 42*c*). Preferably, the stepped support members 42 are concave V-shaped. Further, the tip of such V-shape is preferably rounded. Each of the stepped support members 42 correspond to each of the stepped pivot members 40. Although not required, the support interface 36 may be integrally formed with the housing 12 and may conveniently comprise a plastic, for example.

The stepped support members 42 are sized and configured to sequentially cradle respective ones of the stepped pivot members 40 for rotating the pivot lever 26 about the support interface 36. As such, the support interface 36 and the pivot interface 32 may be cooperatively sized and configured to translate the rod end 28 of the pivot lever 26 along sequential arced paths associated with respective cradling of the stepped pivot members 40 with the stepped support members 42 for substantially axial movement of the piston rod 18. It is contemplated that such arced paths merge to form an overall substantially linear path. Moreover, it is contemplated that increasing the number of the stepped pivot members 40 and the stepped support members 42 would tend to smoothen the resulting path.

Figure 1:
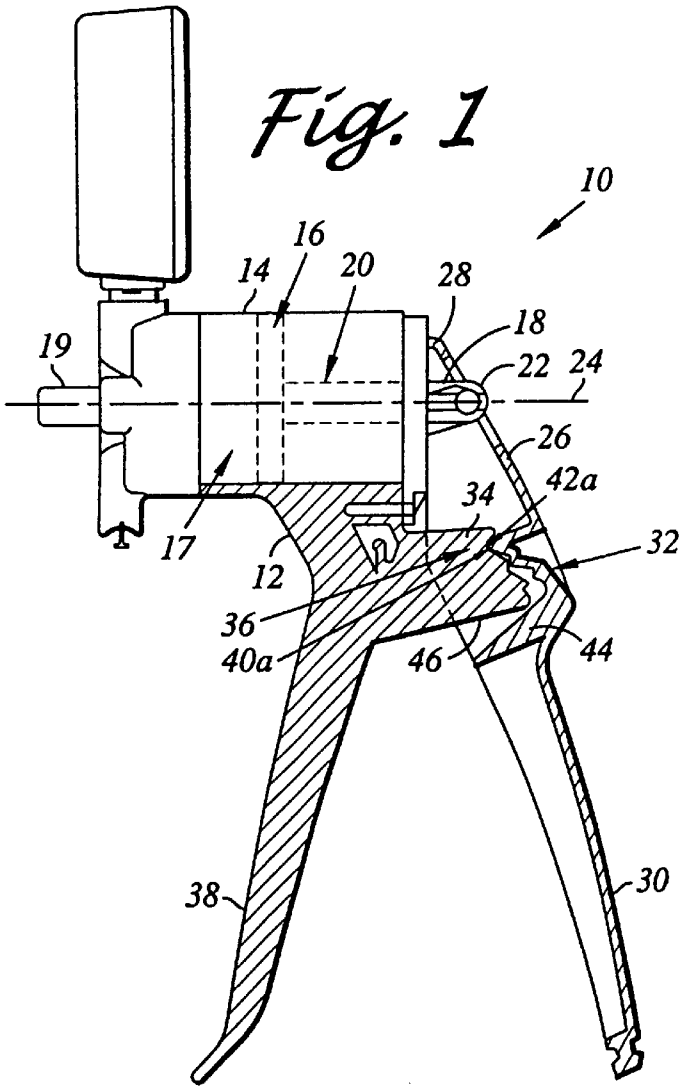
FIG. 1 is a cross-sectional side view of the hand-held vacuum pump of the present invention as shown with a pivot lever thereof in a forward position.

FIGS. 1–4 sequentially depict the pivot lever 26 in various rotational orientations. As can be seen in FIG. 1, the piston 16 is disposed in a leftmost position. The stepped pivot member 40*a* is cradled by the stepped support member 42*a*. It is understood that rotation of the pivot lever 26 from this position results in slidable rotation of the stepped pivot member 40*a* with the stepped support member 42*a*. In this regard, such rotation of the pivot lever 26 initially begins adjacent the interface between the stepped pivot member 40*a* and the corresponding stepped support member 42*a*. Referring now to FIG. 2, as can be seen the pivot lever 26 is shown to be rotated clockwise with respect to the orientation as shown in FIG. 1. The sole engagement between the stepped pivot member 40*a* and the stepped support member 42*a* as shown in FIG. 1 transitions to include respective engagements between the stepped pivot member 40*b* and the stepped pivot member 42*b*. As such, the pivot or rotation point of the pivot lever 26 for a given angular orientation of the pivot lever 26 shifts or transitions with the respective engagements of the stepped pivot members 40*a–c* and stepped pivot member 42*a–c*. In this regard, FIGS. 3 and 4 sequentially depict such shifts or transitions of engagements between the stepped pivot members 40*b* and 40*c* and stepped pivot members 42*b* and 42*c*. Accordingly, such transitions are contemplated to result in a cam-like interaction between the pivot lever 26 and the pivot support 34, and more particularly, between the pivot interface 32 and the support interface 36. Thus, the pivot interface 32 and support interface 36 are particularly configured such that the pivot or rotation point of the pivot lever 26 is a function of its angular orientation.

In addition, the vacuum pump 10 may further include a forward handle 38 which is disposed in fixed relation to the pivot support 34. The forward handle 38 may conveniently be integrated with and extend from the pivot support 34 as well as the housing 12. In actuating the vacuum pump 10, and in particular the piston 16 thereof, a user may simultaneously hold the forward handle 38 and the handle end 30 of the pivot lever 26 in clasped engagement towards each other.

Figure 4:
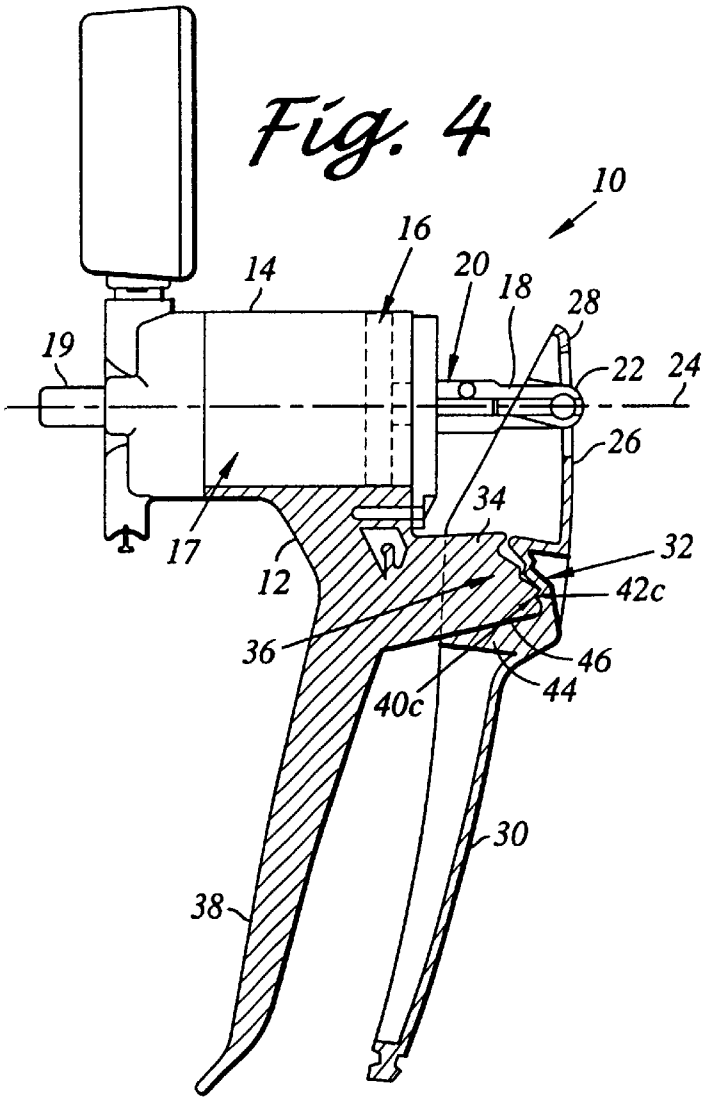
FIG. 4 is the vacuum pump of FIG. 3 with a piston end of the pivot lever rotated rearward.
Figure 3:
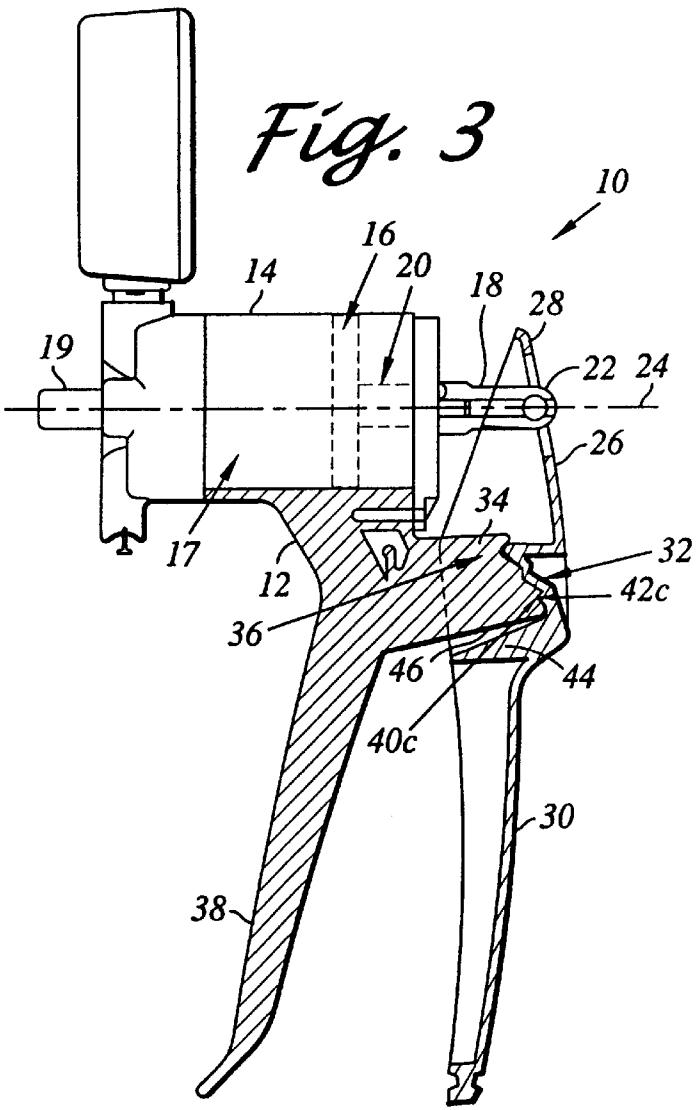
FIG. 3 is the vacuum pump of FIG. 2 with a piston end of the pivot lever rotated rearward.

In addition, the pivot lever 26 further includes a rotational stop 44 sized and configured to prevent rotation of the pivot lever 26 as depicted in FIG. 4. In this regard, the pivot support 34 may be provided with a stopping surface 46. The rotational stop may be sized and configured to engage the pivot support, and in particular the stopping surface 46, for preventing rotation of the pivot lever 26.

Additional modifications and improvements of the present invention may also be apparent to those of ordinary skill in the art. Thus, the particular combination of parts described and illustrated herein is intended to represent only one embodiment of the present invention, and is not intended to serve as limitations of alternative devices within the spirit and scope of the invention.

What is claimed is:

1. A hand-held vacuum pump comprising:

a piston for drawing a vacuum;

a piston rod having a piston end and a distal end, the piston end being attached to the piston;

a pivot lever having a rod end, a handle end, and a pivot interface disposed therebetween, the rod end being rotatably attached to the distal end of the piston rod; and a pivot support having a support interface, the support interface being cooperatively sized and configured with the pivot interface to translate the rod end of the pivot lever in substantially axial movement of the piston rod upon rotation of the pivot lever about the support interface in response to actuation of the handle end of the pivot lever, wherein the pivot interface has at least two stepped pivot members, and the support interface has at least two stepped support members sized and configured to sequentially cradle respective ones of the at least two stepped pivot members for rotating the pivot lever about the support interface.

2. The hand-held vacuum pump of claim 1 wherein the support interface and the pivot interface are cooperatively sized and configured to translate the rod end of the pivot lever along sequential arched paths associated with respective cradling of the stepped pivot members with the stepped support members for substantially axial movement of the piston rod upon rotation of the pivot lever about the support interface in response to actuation of the handle end of the pivot lever.

3. The hand-held vacuum pump of claim 1 wherein the at least two stepped support members comprises three stepped support members, and the at least two stepped support members comprises three stepped support members.

4. The hand-held vacuum pump of claim 1 wherein the stepped pivot members are convex V-shaped.

5. The hand-held vacuum pump of claim 1 wherein the stepped support members are concave V-shaped.

6. The hand-held vacuum pump of claim 1 vacuum pump further includes a forward handle disposed in fixed relation to the pivot support for actuating the piston upon clasped engagement of the forward handle and the handle end of the pivot lever towards each other.

7. The hand-held vacuum pump of claim 6 wherein the pivot support is integrated with the forward handle.

8. A hand-held vacuum pump comprising:

a piston for drawing a vacuum;

a piston rod having a piston end and a distal end, the piston end being attached to the piston;

a pivot lever having a rod end, a handle end, and a pivot interface disposed therebetween, the rod end being rotatably attached to the distal end of the piston rod wherein the pivot lever further includes a rotational stop sized and configured to prevent rotation of the pivot lever; and a pivot support having a support interface, the support interface being cooperatively sized and configured with the pivot interface to translate the rod end of the pivot lever in substantially axial movement of the piston rod upon rotation of the pivot lever about the support interface in response to actuation of the handle end of the pivot lever.

9. The hand-held vacuum pump of claim 8 wherein the rotational stop is sized and configured to engage the pivot support for preventing rotation of the pivot lever.

10. A hand-held vacuum pump comprising:

a piston for drawing a vacuum;

a piston rod having a piston end and a distal end, the piston end being attached to the piston;

a pivot lever having a rod end, a handle end, and a pivot interface disposed therebetween, the rod end being rotatably attached to the distal end of the piston rod, the pivot interface having at least two stepped pivot members; and a pivot support having a support interface, the support interface having at least two stepped support members sized and configured to sequentially cradle respective ones of the at least two stepped pivot members for rotating the pivot lever about the support interface; and wherein the support interface and the pivot interface are cooperatively sized and configured to translate the rod end of the pivot lever in substantially axial movement of the piston rod upon rotation of the pivot lever about the support interface in response to actuation of the handle end of the pivot lever.

11. The hand-held vacuum pump of claim 10 wherein the support interface and the pivot interface are cooperatively sized and configured to translate the rod end of the pivot lever along sequential arced paths associated with respective cradling of the stepped pivot members with the stepped support members for substantially axial movement of the piston rod upon rotation of the pivot lever about the support interface in response to actuation of the handle end of the pivot lever.

12. The hand-held vacuum pump of claim 10 wherein the at least two stepped pivot members comprises three stepped pivot members, and the at least two stepped support members comprises three stepped support members.

13. The hand-held vacuum pump of claim 10 wherein the stepped pivot members are convex V-shaped.

14. The hand-held vacuum pump of claim 10 wherein the stepped support members are concave V-shaped.

15. The hand-held vacuum pump of claim 10 vacuum pump further includes a forward handle disposed in fixed relation to the pivot support for actuating the piston upon clasped engagement of the forward handle and the handle end of the pivot lever towards each other.

16. The hand-held vacuum pump of claim 15 wherein the pivot support is integrated with the forward handle.

17. The hand-held vacuum pump of claim 10 wherein the pivot lever further includes a rotational stop sized and configured to prevent rotation of the pivot lever.

18. The hand-held vacuum pump of claim 17 wherein the rotational stop is sized and configured to engage the pivot support for preventing rotation of the pivot lever.

* * * * *